US005311825A

United States Patent [19]

Bonham

[11] Patent Number: 5,311,825

[45] Date of Patent: May 17, 1994

[54] TABLE CORNER APPARATUS AND METHOD OF MINIMIZING DAMAGE FROM IMPACT

[75] Inventor: Brent Bonham, Orem, Utah

[73] Assignee: Mity-Lite, Inc., Salt Lake City, Utah

[21] Appl. No.: 923,261

[22] Filed: Jul. 31, 1992

[51] Int. Cl.[5] ..... A47B 13/08; A47B 17/00

[52] U.S. Cl. ..... 108/27; 248/345.1; 312/140.3

[58] Field of Search ..... 108/27; 312/140.3, 229; 248/345.1

[56] References Cited

U.S. PATENT DOCUMENTS

| | | | |
|---|---|---|---|
| 1,542,138 | 6/1925 | Hunter | 108/27 |
| 2,539,461 | 1/1951 | Norquist | 312/140.3 |
| 2,542,860 | 2/1951 | Clements | 312/140.3 |
| 2,681,261 | 6/1954 | Blink | 108/27 |
| 2,786,727 | 3/1957 | Nordmark | 108/27 |
| 3,219,401 | 11/1965 | Mapson | 108/27 |
| 3,836,043 | 9/1974 | Levin | 248/345.1 |
| 3,960,354 | 6/1976 | Simikoski | 108/27 |
| 4,278,196 | 7/1981 | Ford | 248/345.1 |
| 4,727,816 | 3/1988 | Virtue | 248/345.1 |
| 5,081,725 | 1/1992 | Neese | 248/345.1 |

FOREIGN PATENT DOCUMENTS

| | | | |
|---|---|---|---|
| 3641967 | 10/1987 | Fed. Rep. of Germany | 108/27 |

*Primary Examiner*—Michael Milano

*Attorney, Agent, or Firm*—Thorpe, North & Western

[57] ABSTRACT

A table corner apparatus comprises a tabletop having a corner formed from the intersection of two side edges, two peripheral elongate support beams mounted to the underside of the tabletop near and parallel to the two side edges, each beam having an end located near the corner with the ends also located near each other, and a plastic web disposed between the support beam ends. A rigid corner insert mounted in the corner comprises an edge insert disposed adjacent the side edges at the corner, an impact block disposed between the edge insert and the exterior surfaces, relative to the center of the tabletop, of the support beams and web, a retaining block disposed oppositely from the impact block at the interior surfaces of the support beams and web, and a rigid connector between the retaining and impact blocks. A method of minimizing impact damage to the table corner comprises receiving the impact at the corner insert and transferring the force of the impact to the support beams.

16 Claims, 3 Drawing Sheets

TABLE CORNER APPARATUS AND METHOD OF MINIMIZING DAMAGE FROM IMPACT

FIELD OF THE INVENTION

The present invention concerns the field of tables and corners for tables, and especially corners for lightweight tables and methods which are designed for resistance to dents, breakage, and other types of damage.

BACKGROUND OF THE INVENTION

There exists a continual need in the art to improve the strength and damage resistance of lightweight tables. This need exists because, in general, a trade-off between strength and weight must be made, i.e., the lighter the table, the weaker and more vulnerable to damage it is. Table corners are especially vulnerable since they are very likely to be hit and scraped against door frames and walls during moving of the table, and hit by chairs and other objects when stationary. Damage is of particular concern with portable tables which are bumped and jarred with some frequency. Permanent heavier tables are also subject to damage, but since their tops are usually heavy and durable the problem is minimal. Some tables deal with the problem of corner damage by eliminating corners altogether, such as round and oval tables.

The table edges and corners of most lightweight and/or portable tables are thin and therefore vulnerable even to hits of relatively little force. Peripheral reinforcements or supports such as beams underneath the tabletop are usually displaced inward from the table edge to facilitate grasping the edge by hand during movement. This forms an outer periphery of a few inches between the support beam and the edge of the table, causing the corner to be farther away from the support beams than any other point on the table edge. No matter how thick the tabletop is, therefore, the corner will be more vulnerable to damage than the rest of the tabletop edge.

A table corner is damaged principally through two kinds of impacts. The first of these, referred to as lateral or horizontal impacts, dent and damage the corner diminishing its strength and visual appearance and occasionally completely breaking off the corner. A downward or vertical impact, on the other hand, will bend or completely break off the corner given the absence or small amount of supporting material beneath the outer periphery.

Cobos et al., U.S. Pat. No. 4,951,576, discloses a strengthening apparatus for tables comprising gussets mounted at the corners of the table interior to the intersection of the peripheral support beams. Though the gussets appear to strengthen the table much as any support material would, they do not support the most vulnerable portion of the table corner between the edge and the peripheral support beams.

Other prior art tables thicken or otherwise strengthen the entire tabletop to properly support and strengthen the corners. This type of reinforcement increases weight and cost of materials, and does nothing to strengthen the corner relative to the rest of the table.

OBJECTS AND SUMMARY OF THE INVENTION

It is therefore an object of the present invention to overcome the shortcomings of the prior art weak peripheral table structure.

It is a further object of the invention to provide a lightweight table whose corners are strong and resistant to damage from both horizontal and vertical impacts.

It is a further object of the invention to provide a table corner insert which transfers the force of an impact into the peripheral support beams which are better able to absorb and withstand the force with a minimum of damage.

It is a further object of the invention to provide a table corner insert which can be replaced conveniently when needed.

It is a further object of the invention to minimize the material needed for construction of a tabletop, thereby decreasing weight and expense.

In accordance with a first aspect of the invention, a table corner apparatus comprises a tabletop having a corner, the corner comprising the intersection of first and second outer edges of the tabletop, an elongate support beam mounted underneath and substantially parallel to the tabletop and having an end disposed inwardly from the corner, and a durable corner insert disposed at the corner adjacent the first and second edges and intersection thereof. The corner insert comprises an outer body section having an abutment surf ace which abuts the end of the support beam, whereby when the corner insert is impacted, at least part of the force of the impact is transferred through the outer body section and abutment surface and into the support beam.

In accordance with a second aspect of the invention, a table corner insert adapted for placement at a corner of a table having a tabletop and a support member disposed beneath the tabletop comprises an edge section adapted for placement adjacent the edge of the tabletop and a force transfer section adapted for placement between the edge section and the support member, wherein the force transfer section transfers impact force from the edge section into the support member.

In accordance with a third aspect of the invention, a method of minimizing damage from an impact at or near the corner of a tabletop formed by the intersection of two side edges of the tabletop, the tabletop including at least one support beam oriented parallel to the plane of the tabletop and having an end disposed near the corner of the tabletop and including a corner buttress disposed at the corner of the tabletop and abutting the end of the support beam, comprises the steps of receiving the force of the impact at the corner buttress and transferring a substantial portion of the force of the impact from the corner buttress into the support beam through the abutment of the corner buttress against the end of the support beam.

Specifically, and in a preferred embodiment, a table corner apparatus comprises a tabletop having first and second side edges which intersect to form a corner, a first peripheral elongate support beam mounted under the tabletop parallel to and near the first side edge of the tabletop and having an end disposed near the corner of the tabletop, and a second peripheral elongate support beam mounted under the tabletop parallel to and near the second side edge of the tabletop and having an end disposed near the corner of the tabletop and near the end of the first support beam. A web is formed between the ends of the first and second support beams. A rigid retainer block is mounted underneath the tabletop adjacent the interior surfaces, relative to the center of the tabletop, of the first and second support beams and web, and a rigid impact block is mounted underneath the tabletop adjacent the exterior surfaces, relative to the center of the tabletop, of the first and second support beams and web. Connecting means are provided for rigidly connecting the retainer block to the impact block and a rigid edge insert is mounted between the impact block and the first and second side edges of the tabletop which form the corner.

BRIEF DESCRIPTION OF THE DRAWINGS

These and other objects, aspects, and embodiments of the present invention will be described with reference to the following drawing figures, of which.

DETAILED DESCRIPTION OF THE INVENTION

Figure 1:
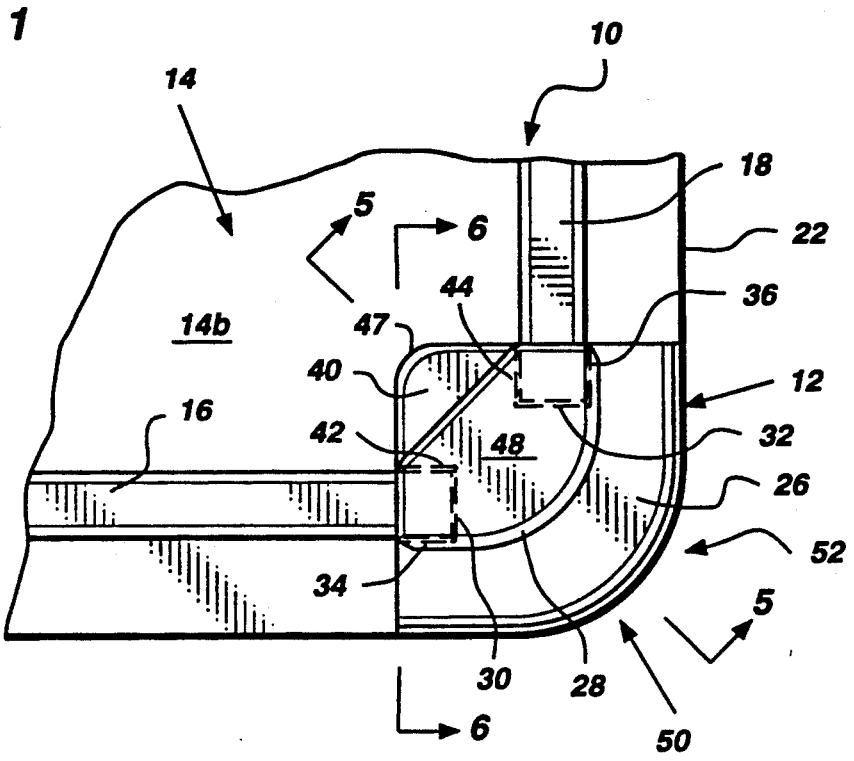
FIG. 1 is a partial bottom plan view of an example of a table having a corner insert according to the invention.
Figure 2:
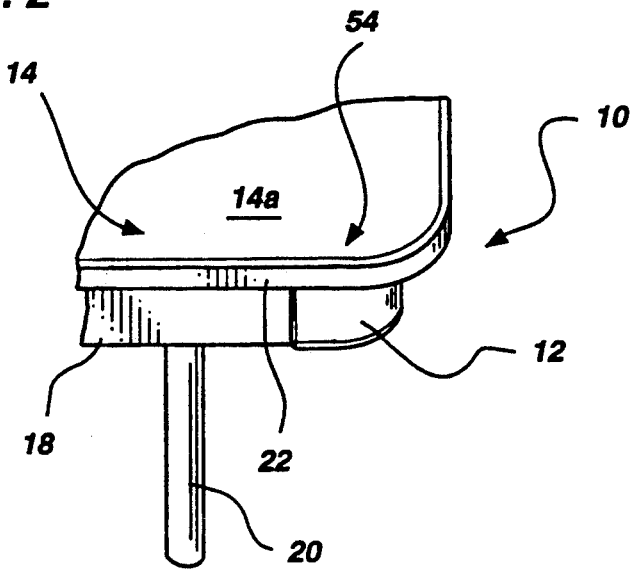
FIG. 2 is a partial perspective view of the table of FIG. 1.

Referring first to FIGS. 1 and 2, a table 10 having a corner insert 12 is shown. The table 10 has a tabletop 14 and two peripheral support beams 16 and 18 mounted beneath the tabletop 14 in a standard configuration near the periphery of the tabletop 14 for strength and for support of the legs 20 of the table. Other support beams are supplied as needed to support the portion of the table 10 not shown in the figures.

As is described in Applicant's co-pending patent application no. 07/833,014, now U.S. Pat. No. 5,271,338 hereby incorporated into this specification as though fully set forth herein, the tabletop 14 preferably comprises a thin support layer of wood with a plastic covering laminated to the support layer on the upper surface of the tabletop 14*a*. In the referred embodiment, the plastic covering bends over the edge of the tabletop and depends downwardly therefrom to form a plastic protective edge 22 around the perimeter of the table. Additionally, a bottom plastic covering similar to the top covering is formed on the bottom surface 14*b* of the tabletop 14 and on the support beams 16, 18. In a preferred embodiment, the bottom covering is vacuum formed on the bottom surface 14*b* and support beams 16, 18 to conform to the shape thereof.

Figure 3:
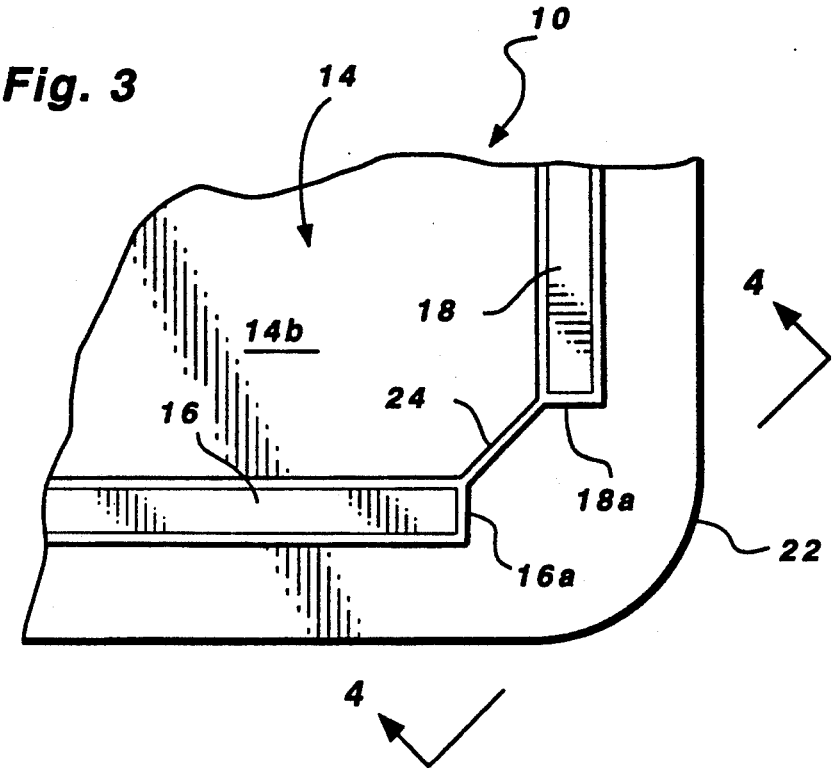
FIG. 3 is a partial bottom plan view of the table of FIG. 1 without the corner insert.
Figure 4:
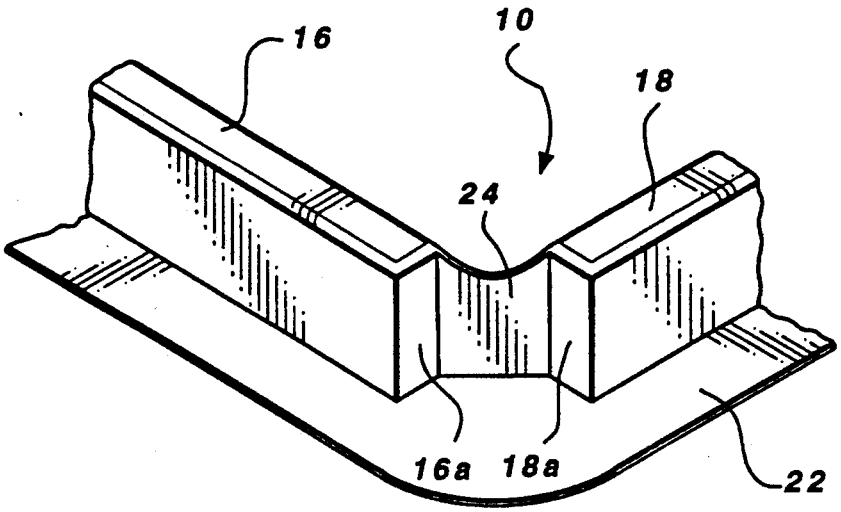
FIG. 4 is a view along line 4—4 in FIG. 3.

Referring now to FIGS. 3 and 4, in a preferred embodiment the support beams 16,18 are mounted under the tabletop 14 such that each beam has an end 16*a*, 18*a* disposed near a corner of the table and near the end of the opposite beam but not touching it. Alternatively, the support beams 16,18 can be conventionally constructed with the end of one abutting the end of the other to form a continuous peripheral support around the entire underside of the table. When the bottom plastic cover is vacuum formed onto the lower surface 14*b* of the tabletop and the preferred arrangement of the support beams 16,18, a web of plastic 24 is formed between the ends of the beams 16*a*,18*a*. In the referred embodiment, the edge of the web 24 curves toward the table 14. The curve is often a natural consequence of the vacuum forming process.

Figure 5:
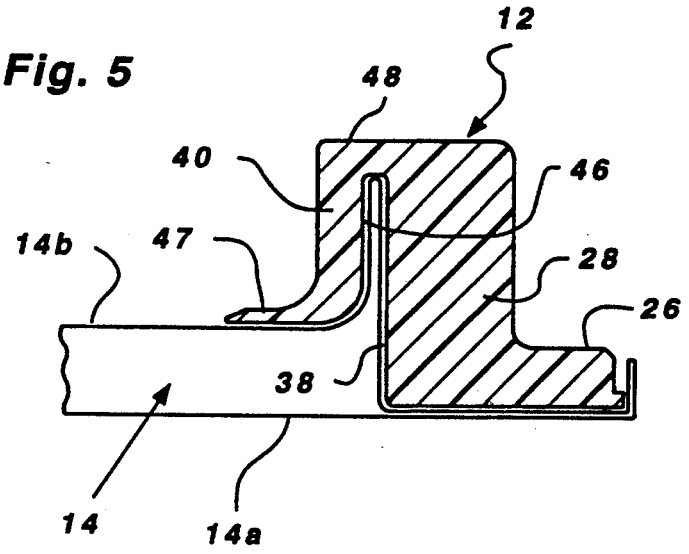
FIG. 5 is a view along line 5—5 in FIG. 1.
Figure 6:
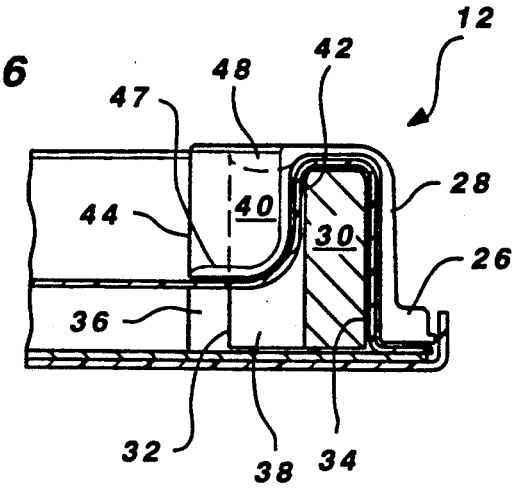
FIG. 6 is a view along line 6—6 in FIG. 1.

Referring now to FIGS. 1, 5, and 6, in the preferred embodiment the corner insert 12 is constructed of rigid and durable plastic such as CYCALOY TM, an alloy of ABS plastic and polycarbonate manufactured by General Electric Corporation. The insert is designed for clamping action placement at the corner of the table 10 on the support beams 16,18 in addition to (or alternatively to) an adhesive securing it in place.

The insert 12 comprises a flat curved edge section 26 which fits tightly between the protective edge 22 and the rest of the insert 12 to minimize movement of the edge 22 when it is hit or scraped. An outer body section 28 of the insert is constructed integrally with and at the interior of the edge 26, and completes the filling of the gap between the support beams 16,18 and the protective edge 22. The outer body section 28 includes two flat surfaces 30,32 which are adapted to abut the ends of the support beams 16*a*,18*a* when the insert is in place, and flat surfaces 34,36 which press against the outer surfaces of the support beams 16,18 when the insert 12 is in place. The outer body 28 further comprises a flat central surface 38 disposed between the surfaces 30,32 which presses against the web 24 when in the insert is in place. The distance between the flat surfaces 30, 32, 34, 36, 38 and the outer perimeter of the edge section 26 is approximately the distance from the support beam ends and outer side surfaces to the protective edge 22, respectively, so that the insert fits snugly into the corner of the table.

The insert 12 further comprises an inner body section 40 disposed oppositely from the outer body 28 on the inner side of the support beams 16,18 and web 24. The inner body 40 includes flat surfaces 42 and 44 which press against the inner side surfaces of the beams 16,18, respectively, in opposition to the outer flat surfaces 34,36. The inner body 40 also includes a central flat surface 46 between the surfaces 34,36 which presses against the inner surface of the web 24 in opposition to the outer flat surface 38. A short flange 47 extends toward the center of the table from the inner body 40 and presses against the tabletop 14.

A connecting body section 48 formed integral with the inner and outer body sections 40 and 28 is disposed over the support beams 16,18 and web 24 to connect the inner and outer body sections to each other and to pull them together. This connection facilitates clamping action between the surfaces 34, 38, 36 and the surfaces 42, 46, 44, respectively, over the support beams and web. In a preferred embodiment, the connecting section 48 is formed in a dome shape where it meets the web 24 in order to give it strength and to take advantage of the curved shape of the web. The dome shape also allows the connecting section 48 to be relatively thin over the support beams 16,18 when placed thereon, which saves on material and is aesthetically pleasing while still maintaining strength by means of the interior dome.

To construct the apparatus, the support beams 16 and 18 are mounted onto the bottom surface of the table 14*b* through an adhesive or other suitable means, and the bottom cover is vacuum formed and adhered onto the tabletop 14 and support beams 16,18. The corner insert 12 is then slid over the support beams 16,18 (covered by the bottom plastic cover) and web 24 after coating the contact surfaces with a suitable adhesive such as ABS cement. Preferably, the fit of the insert 12 on the beams and web is tight so that the insert 12 is secured thereon with a minimum or absence of adhesive.

The insert 12 lends considerable strength and durability to the table corner. As above described and as will be appreciated from common experience, the corners of a table are the part most vulnerable to bumps, nicks, jars, scrapes, and the like, while the usual corner design of a lightweight table does nothing to reinforce the corner since it has only a thin tabletop extending out from the peripheral support beams. The insert 12 thickens the tabletop edge extending outwardly from the support beams and transfers the force of an impact at the edge of the table to the support beams, which are considerably stronger and more able to withstand a great amount of force.

The operation of the insert 12 can be appreciated by the following illustration. If the corner of the table 10 is hit in a horizontal direction, the portion that will be hit is the protective edge 22. Instead of denting, breaking, or bending back, as in prior art tables, the snug fit of the insert 12 between the protective edge 22 and the support beams 16,18 will keep the protective edge in position and transfer the force to the support beams 16,18 by reason of the snug abutment of the surfaces 30 and 32 against the ends of the beams 16*a* and 18*a*. The force will then be absorbed along the length of the support beams. If the direction of the impact is substantially diagonal to the table 10, such as is illustrated by the arrow 50 in FIG. 1, each support beam 16,18 will absorb a substantially equivalent amount of the impact force. If the direction of the impact is to one side of the corner, such as is illustrated by the arrow 52 in FIG. 1, a single beam, in this case the beam 16, will absorb most of the impact.

The insert 12 also minimizes the damage caused by a downward vertical impact upon the corner of the table as shown by the arrow 54 in FIG. 2. In a conventional lightweight table with a thin and therefore relatively weak tabletop, a downward vertical force on the corner can result in damage even to the point of the corner breaking off. The insert 12 minimizes damage in two ways, first, by supporting the tabletop portion between the protective edge 22 and the support beams 16,18 through the pressure of the surfaces 34 and 30, 38, 32 and 36 against the support beam 16, the web 24, and the support beam 18, respectively. Second, for a downward impact to be able to flex and therefore bend or break the corner, the outer body and edge sections 28 and 26 must also be downwardly flexed. This flexion is prevented by the pressure of the inner body section 40 against the support beams 16,18 and the web 24. The inner body section 40 is therefore substantially prevented from flexion and, since the outer section 28 is rigidly connected to the inner section 40 through the connecting section 48, the outer section 28 is likewise prevented from flexion and consequent breakage. The edge section 26 also renders the edge of the table resistant to puncture damage through its rigidity and thickness.

The corner insert 12 enables the use of thinner top plastic covers on the upper surface of the tabletop 14*a* because the top cover is not needed to strengthen the table edge when bent down into the protective edge 22. Rather, the protective edge 22 serves as a decorative cover and protector from minor bumps and dents. It is not required to absorb the force of an impact. This significantly decreases materials costs and overall weight without sacrificing strength.

Figure 7:
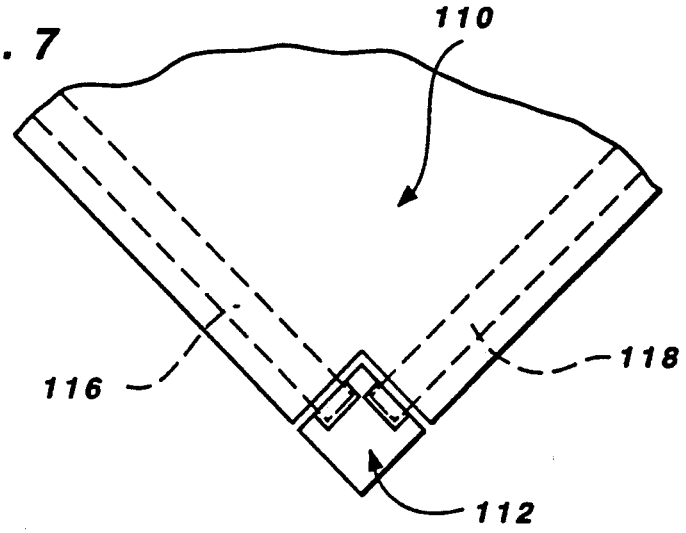
FIG. 7 is a partial top plan view of a second example of a table having another embodiment of a corner insert according to the invention.

Referring now to FIG. 7, a second example of a table 110 having a removable corner insert 112 is shown. The removable insert 112 is desirable, for example, when the table is desired to have sharp corners instead of slightly rounded ones as previously described. Sharp corners are much more vulnerable to damage both as to structure and as to appearance, and even a strong corner insert can in time wear down. The insert 112 is also desirable in situations where the corner is subject to an excessive number of hard impacts. In either of these cases, the corner may be removed and replaced as often as necessary.

The removable corner insert 112 may be anchored by securing it to the ends of support beams 116 and 118 in a similar fashion to that described above other anchoring means will be apparent to those skilled in the art in light of this disclosure.

The corner inserts herein described can be used on a variety of table shapes and constructions, and on corners of various angles and thicknesses. Modifications and variations to the described embodiments within the scope of the invention will be apparent to those skilled in the art, e.g., the means of mounting the corner insert to the table, the arrangement of the support beams, the materials used, etc. It is also contemplated that the corner insert could be made of an elastic or yielding material that absorbs much of the force of the impact internally.

I claim:

1. A table corner apparatus comprising:

a tabletop having a corner, the corner comprising the intersection of first and second outer edges of the tabletop;

a first elongate support beam mounted underneath and subs substantially parallel to the tabletop, and having an end disposed inwardly from the corner, wherein said support beam is disposed near and substantially parallel to the first outer edge;

a second elongate support beam mounted underneath and substantially parallel to the tabletop, and substantially parallel to the second outer edge, and having an end disposed inwardly from the corner;

a web formed between the ends of the first and second support beams;

a durable corner insert disposed at the corner adjacent the first and second edges and intersection thereof, said corner insert comprising an outer body section having an abutment surface which abuts the end of the first support beam and a first clamping surface which abuts the web, wherein said outer body section includes a second abutment surface which abuts the end of the second support beam, whereby when the corner insert is impacted at least part of the force of the impact is transferred through the outer body section and at least one of the abutment surfaces to the corresponding support beam.

2. The apparatus of claim 1 wherein the corner insert further comprises an inner body section disposed oppositely of the web and support beams from the outer body section, and connecting means for rigidly connecting the outer body section to the inner body section, and wherein the inner body section comprises a second clamping surface which abuts the side of the web opposite the abutment of the first clamping surface, thereby clamping the web between the inner and outer body sections and further securing the corner against damage from vertical impact.

3. The apparatus of claim 2 wherein the inner body section further comprises third and fourth clamping surfaces which abut the inner surfaces of the first and second support beams, respectively, near the ends thereof and wherein the outer body section further comprises fifth and sixth clamping surfaces which abut the outer surfaces of the first and second support beams, respectively, near the ends thereof.

4. The apparatus of claim 2 wherein the web is curved toward the tabletop and wherein the connecting means comprises a connecting body section formed integrally with the inner and outer body sections and disposed underneath the web, the connecting body section being formed in a dome shape filling the curve of the web.

5. The apparatus of claim 1 wherein the web is formed from a plastic bottom cover layer which is vacuum-formed on the bottom of the tabletop and the support beams.

6. The apparatus of claim 1 wherein the corner insert further comprises an edge section which extends outwardly from the outer body section and is disposed adjacent the first and second edges and the intersection thereof.

7. The apparatus of claim 1 wherein the corner insert comprises an alloy of ABS plastic and polycarbonate.

8. The apparatus of claim 1 wherein the first and second support beams are approximately perpendicular to each other.

9. A table corner apparatus comprising:

a tabletop having first and second side edges which intersect to form a corner;

a first peripheral elongate support beam mounted under the tabletop parallel to and near the first side edge of the tabletop, and having an end disposed near the corner of the tabletop;

a second peripheral elongate support beam mounted under the tabletop parallel to and near the second side edge of the tabletop, and having an end disposed near the corner of the tabletop and near the end of the first support beam;

a web formed between the ends of the first and second support beams;

a rigid retainer block mounted underneath the tabletop adjacent the interior surfaces, relative to the center of the tabletop, of the first and second support beams and web;

a rigid impact block mounted underneath the tabletop adjacent the exterior surfaces, relative to the center of the tabletop, of the first and second support beams and web;

connecting means for rigidly connecting the retainer block to the impact block;

a rigid edge insert mounted between the impact block and the first and second side edges of the tabletop which form the corner.

10. The apparatus of claim 9 further comprising a plastic bottom cover vacuum molded onto the bottom of the tabletop and the first and second support beams, and wherein the web is formed as a result of the vacuum molding and has a curvature toward the tabletop.

11. The apparatus of claim 10 wherein the connecting means is disposed beneath the web and the first and second support beams and is domed to fill the space formed by the curvature of the web.

12. The apparatus of claim 9 wherein the retaining block, the connecting means, the impact block, and the edge insert are integrally formed with one another creating an integral corner insert.

13. The apparatus of claim 12 wherein the corner insert comprises ABS plastic.

14. The apparatus of claim 12 wherein the corner insert forms part of the tabletop.

15. The apparatus of claim 9 wherein the retaining block and the impact block clamp the first and second support beams and web between them.

16. The apparatus of claim 9 further comprising a top plastic cover over the upper surface of the tabletop which is bent down over the first and second edges to form a protective plastic edge, and wherein the edge insert is disposed between the protective edge and the impact block.

* * * * *